US005316160A

United States Patent [19]

Cautereels

[11] Patent Number: 5,316,160

[45] Date of Patent: May 31, 1994

[54] BABY BOTTLE ASSEMBLY

[75] Inventor: Victor J. J. Cautereels, Borsbeek, Belgium

[73] Assignee: Dart Industries Inc., Deerfield, Ill.

[21] Appl. No.: 940,562

[22] Filed: Sep. 4, 1992

[51] Int. Cl.[5] ..... A61J 9/00; A61J 11/04

[52] U.S. Cl. ..... 215/11.1

[58] Field of Search ..... 215/11.1, 11.5, 208, 215/223

[56] References Cited

U.S. PATENT DOCUMENTS

| | | | |
|---|---|---|---|
| 2,424,629 | 7/1947 | Patterson | 215/11.1 |
| 2,760,665 | 8/1956 | Zenker | 215/11.1 |
| 2,831,596 | 4/1958 | Eyles | 215/11.1 |
| 2,836,321 | 5/1958 | Soltesz et al. | 215/11.1 |
| 2,843,281 | 7/1958 | Gallois | 215/11.1 |
| 2,864,520 | 12/1958 | Pitavy | 215/11.1 |
| 2,885,104 | 5/1959 | Greenspan | 215/11.1 X |
| 3,827,593 | 8/1974 | Kramb et al. | 215/208 |
| 4,032,028 | 6/1977 | Reiss et al. | 215/217 |
| 4,058,232 | 11/1977 | Ohno et al. | 215/223 X |
| 4,613,050 | 9/1986 | Atkin et al. | 215/11.5 |
| 4,620,638 | 11/1986 | Schmidt | 215/11.1 |
| 4,676,388 | 6/1987 | Kuboshima | 215/217 |
| 5,024,341 | 6/1991 | Dekerle | 215/11.1 |
| 5,150,801 | 9/1992 | Held | 215/11.1 X |

FOREIGN PATENT DOCUMENTS

| | | | |
|---|---|---|---|
| 8903204 | 4/1989 | PCT Int'l Appl. | 215/11.1 |
| 324194 | 1/1930 | United Kingdom | 215/11.1 |
| 1332175 | 10/1973 | United Kingdom | 215/11.5 |

*Primary Examiner*—Sue A. Weaver
*Attorney, Agent, or Firm*—John A. Doninger

[57] ABSTRACT

An assembly for mounting a nipple to a baby bottle including an adapter supporting the nipple against free movement through the bottle mouth, and a mounting collar with threaded fasteners engaging complementary fasteners on the bottle and clamping the nipple and adapter to the bottle. The position of the threads allows free rotating of the collar relative to the bottle threads in the absence of the adapter.

8 Claims, 2 Drawing Sheets

BABY BOTTLE ASSEMBLY

BACKGROUND OF THE INVENTION

Baby Bottles of the type intended for reuse, that is of glass or an equivalent rigid synthetic resinous material capable of being washed and sterilized, have conventionally been provided with rather narrow mouths.

The narrow mouth, or more particularly the mouth rim, directly receives the annular flange of a conventional nipple which is in turn sealed to the rim by a mounting collar.

In order to facilitate cleaning of the bottles, it has been proposed to provide bottles with wide mouths, that is mouths with a diametric dimension only slightly less than that of the bottle itself. A bottle so formed is easily cleaned and sterilized, with the interior of the bottle readily visible through the wide mouth and with the actual filling of the bottle greatly simplified.

However, a problem arises in accommodating the conventionally sized nipples to the wide mouth bottles. One solution to this problem involves the use of removable adapters which can overlie and project inwardly of the mouth rim to provide a support for the conventional nipples.

The provision of an adapter, while allowing use of a conventional size nipple, also gives rise to problems. Most particularly, it is not an infrequent occurrence that the nipple is mounted to the bottle without first positioning the adapter. Basically, the nipple is lightly frictionally retained within the mounting cap and the cap and nipple mounted as a unit. As such, the nipple will appear to be properly seated even in the absence of the adapter. However, the absence of the adapter will become immediately apparent in that as the bottle is inverted or as soon as any pressure is applied to the nipple, the nipple will retract into the bottle through the wide mouth and the liquid in the bottle will discharge in an uncontrolled manner. Thus, the proper positioning of the adapter is essential.

SUMMARY OF THE INVENTION

The present invention involves a baby bottle assembly utilizing a wide mouth bottle, a conventional size nipple, an adapter to accommodate the nipple to the wide mouth, and a mounting collar. In addition, and more specifically, the invention, through a unique interrelationship between the components, provides a system for physically indicating the absence of the adapter, as the nipple is mounted.

More particularly, the mounting collar and bottle neck are provided with cooperating fasteners, preferably aligned discontinuous threads peripherally about the exterior of the neck and similar threads about the interior of the collar. With the adapter properly seated on the bottle rim, the annular top panel of the collar will, upon a mounting of the collar on the bottle, engage the adapter, either directly or through the nipple, and define the extent of telescopic engagement of the collar over the bottle neck. This engagement is such as to position the complementary fastener means or screw threads for positive and continuous engagement, thus providing for a mounting of the assembly in a substantially conventional manner.

However, the respective positioning of the threads on the bottle neck and collar skirt are such whereby in the absence of the adapter upwardly positioning the collar, a continuous threading of the collar on the neck will quickly move the collar threads below the neck threads at which point the collar will freely spin on the neck, providing both a visual and tactile indication that the adapter is missing and the assembly cannot be sealed. At this stage, the nipple remains loosely frictionally retained by the collar, and as such, the problem can be easily remedied by removing the collar and nipple and positioning the adapter.

Further specifics of the invention will become apparent from the details of the invention as more fully hereinafter presented and claimed.

DESCRIPTION OF PREFERRED EMBODIMENTS

Figure 1:
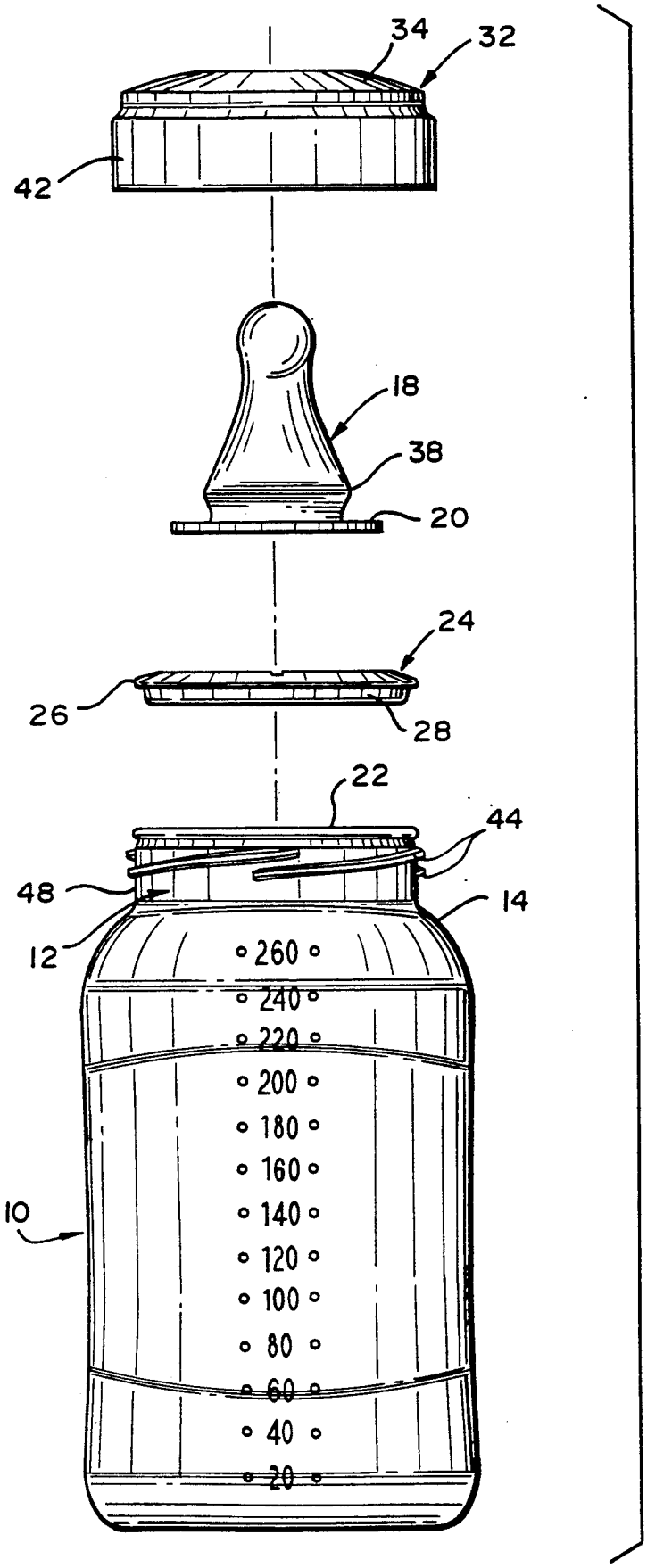
FIG. 1 is an exploded elevational view of the assembly components.

Referring now more specifically to the drawings, the baby or nursing bottle assembly of the invention includes a bottle 10 preferably of constant diameter or cross-sectional area for the full height thereof to an upper neck 12. The neck 12 will normally be of slightly less cross-sectional area or diameter than the main body of the bottle with a bottle shoulder portion 14 defined between the neck and body of the bottle 10. The neck 12 defines the mouth 16 through which the contents of the bottle 10 are introduced and removed. This mouth 16 is a wide mouth, that is substantially larger than the mouth of a conventional baby bottle and of a size which cannot in itself accommodate a conventional baby bottle nipple, herein indicated by reference numeral 18.

The annular mounting flange 20 of the nipple 18 is diametrically substantially smaller than the rim 22 of the bottle mouth 16 and cannot directly seat thereon peripherally thereabout. The relative size relationship will be readily apparent from FIGS. 2 and 3 of the drawings.

In order to accommodate the nipple 18 to the wide mouth 16, an annular adapter 24 is provided. The adapter 24 includes a peripheral lip 26 which seats on the mouth rim 22 completely thereabout, and a depending peripheral skirt 28 which is received within the mouth 16 immediately below the rim 22 for a positioning of the adapter 24. It is contemplated that the exterior surface of the positioning skirt 28 be slightly downwardly and inwardly inclined, as in fact is the inner face of the rim portion of the mouth to provide complementary guide surfaces facilitating an alignment and insertion of the adapter in conjunction with surfaces which both effect a positive liquid seal therebetween and are readily releasable for removal of the adapter 24.

The adapter extends sufficiently radially inward of the positioning skirt 28 to define a support ledge 30 with an upwardly directed support or seating surface upon which the planar mounting flange 20 of the nipple 18 engages. It will of course be appreciated that the inner periphery of the adapter 24 or ledge 30 is outwardly positioned relative to the central flow passage through the nipple 18 so as to not interfere with use of the nipple in the conventional manner. As illustrated, the adapter 24 can also include spaced rigidifying gussets between the skirt 28 and ledge 30.

The nipple flange 20 is directly supported on the adapter 24, which in turn extends radially and circumferentially therebeyond and into supported engagement on the rim 22 of the bottle mouth 16. In the absence of the adapter, and the support provided thereby, the nipple is unsupported and will freely move through the bottle mouth, dropping into the bottle. As such, the presence of the adapter is essential to use of the bottle assembly.

A mounting collar 32 is provided to peripherally enclose and overlie the nipple flange 20, he adapter 24 and the neck 12 of the bottle to mount and secure the nipple in operative position. The collar 32 includes a slightly domed annular top panel 34 with a central opening therein. The top panel 34 has the inner periphery thereof defined by an annular lip 36 which is adapted to engage immediately below an annular convex protuberance or bulge 38 in the nipple 18 in slightly spaced relation above the nipple mounting flange 20. The undersurface 40 of the top panel 34 radially outward of the lip 36 simultaneously engages the upper surface of the nipple flange 20. The size of the central opening of the collar 32 defined by the annular lip 36 is such as to require a slight elastic compressing of the nipple projection 38 to upwardly engage the nipple through the opening and into mounted position on the collar 32. This provides for a slight frictional retention of the nipple 18 for mounting to the bottle 10 as will be explained subsequently.

The top panel 34 of the collar 32 is surrounded by an integral depending mounting skirt 42 which encircles the bottle neck 12 in slightly outwardly spaced relation thereto. Threaded fastener means, in the nature of complementary threads 44 on the exterior surface of the neck 12 and 46 on the interior surface of the collar skirt 42, provide for a mounting of the collar 32 on the bottle neck by, in an obvious manner, rotating the collar 32.

It is contemplated that both sets of threads 44 and 46 comprise a series of discontinuous threads peripherally spaced and slightly overlapped as suggested in FIG. 1 to provide for a quick connect and release.

The internal threads 46 on the collar skirt 42 are provided toward the lower end of the skirt 42. The external threads 44 about the bottle neck 12 are positioned at generally mid-height on the neck 12 in spaced relation above the bottle shoulder 14 providing, between the threads 44 and shoulder 14, a smooth or unencumbered external surface 48 on the neck 12.

Figure 2:
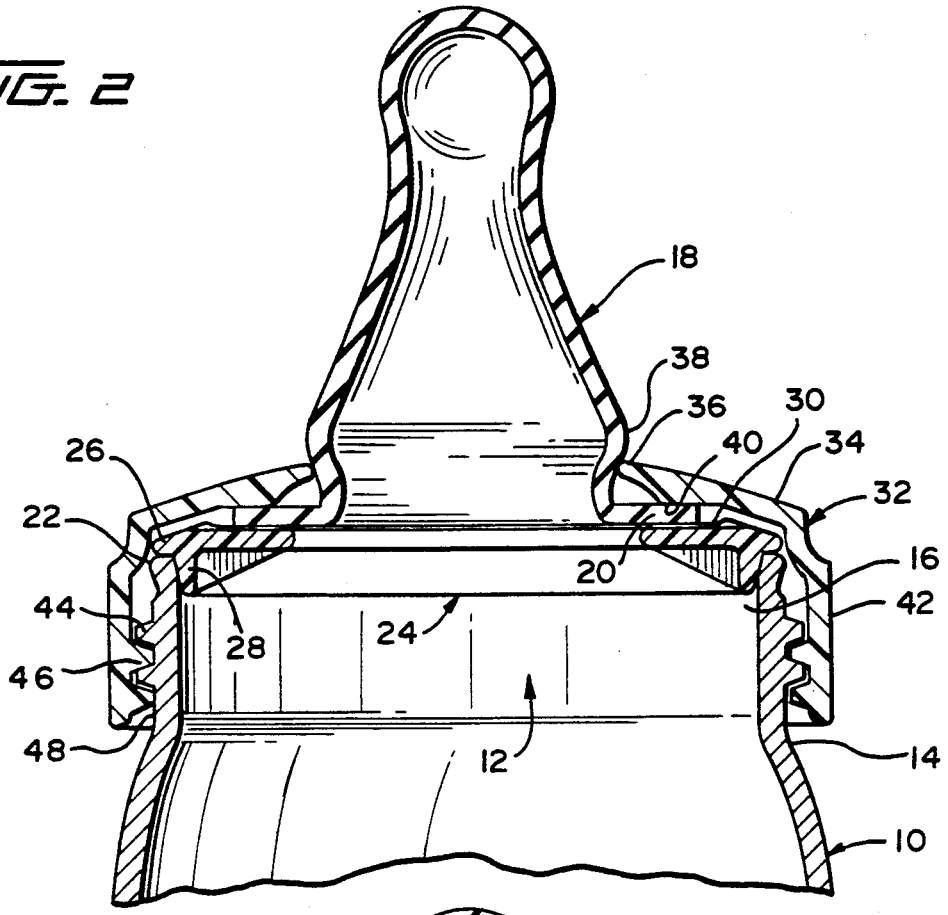
FIG. 2 is a vertical cross section through the mounted nipple with the adapter positioned.

The vertical positioning of the threads 44 and 46 is such whereby with the nipple and adapter positioned, as in FIG. 2, the threads 44 and 46 engage and remain in engagement for the full downward travel of the mounting collar 32 into sealed clamping engagement with the nipple and adapter. Under such circumstances, it will be recognized that downward movement of the mounting collar 32 is limited by engagement of the undersurface 40 of the collar top panel 34 against the nipple flange 20.

Figure 3:
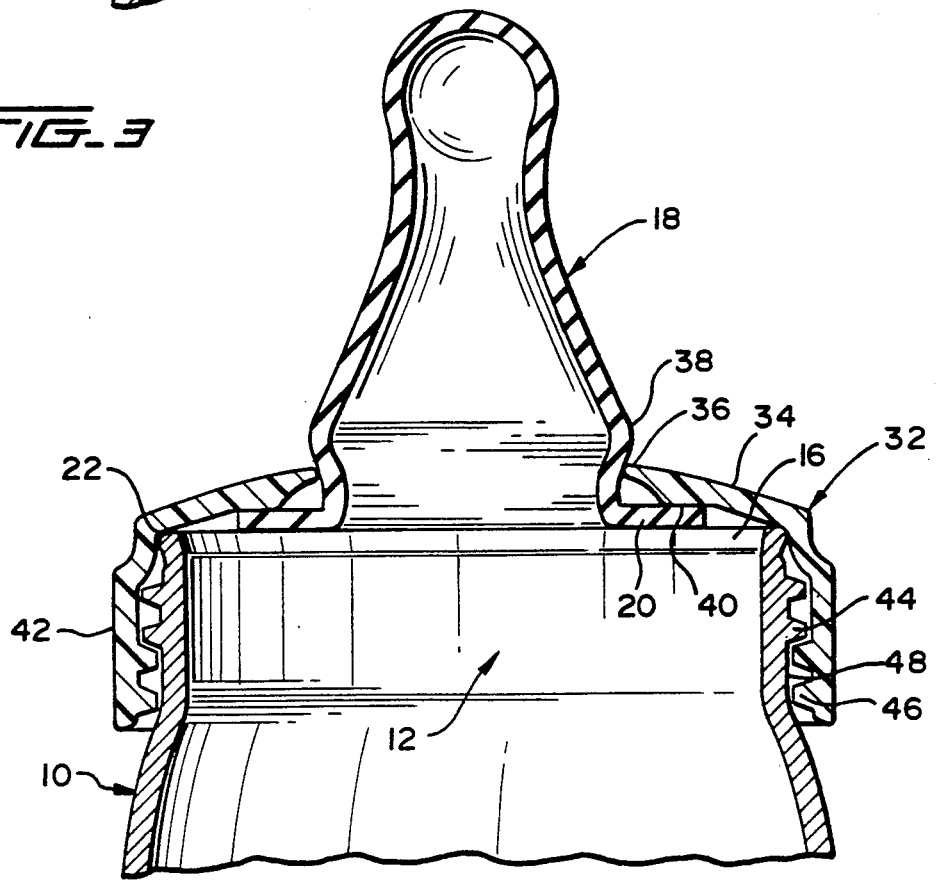
FIG. 3 is a vertical cross section through the mounted nipple with the adapter missing.

Noting FIG. 3, in the absence of the adapter 24, downward travel of the mounting collar 32 will not be limited until such time as the top panel 34 engages the mouth rim 22. At that point, the collar threads 46 will be positioned below the neck threads 44 and aligned with the unencumbered exterior surface 48 of the neck whereby the collar will freely rotate about the neck and immediately indicate to the user that the adapter is missing and there is no sealing of the nipple to the bottle. As will be appreciated, the height of the collar skirt 42 between the undersurface of the top panel 34 and the uppermost extent of the collar threads 46 is greater than the vertical height of the neck 12 between the rim 22 and the lowermost extent of the neck threads 44. Thus, in the absence of the adapter 24, and as the nipple flange 20 will not engage directly on the rim 22, continued mounting rotation of the collar 32 in the absence, of the adapter will ultimately move the collar threads 46 below the neck threads 44 at which point the collar will merely freely spin on the neck and provide an immediate indication of the absence of both the adapter and an effective seal of the nipple to the bottle.

With the additional height provided by the adapter 24, and the nipple flange 20 supported solely by the adapter, the threads 46 and 44 remain in engagement, thereby allowing for a positive clamping and sealing of the nipple to the bottle.

Incidentally, while the nipple has been illustrated in its feeding position, it will be appreciated that the nipple can be inverted into a stored position and similarly supported on the adapter. The assembly will also of course provide an immediate indication of an absence of the adapter in the stored position of the nipple.

From the foregoing, it will be recognized that the invention involves a mounting system for enabling utilization of a conventional nipple with a wide mouth container which, without any external means, additional components beyond those required for the mounting of the nipple, or the like, provides an automatic indication of the proper mounting and sealing of the feeding nipple prior to use.

The foregoing is illustrative of the invention with the scope of the invention being defined by the claims following hereinafter.

I claim:

1. A baby bottle assembly including a bottle with a wide mouth defined by a peripheral rim, a feeding nipple alignable over said mouth radially inward of said rim and dimensionally of a size for free movement through said mouth, a removable adapter overlying and engaged with said rim, said adapter extending radially inward of said rim peripherally thereabout and partially overlying said mouth, said adapter extending partially inward of said nipple peripherally thereabout upon alignment of said nipple over said mouth to define a support for receiving said nipple thereon and precluding passage of said nipple through said mouth, collar means rotatable on and relative to said bottle for clamping said nipple and said adapter against said rim, and cooperating means on said collar means and said bottle for securing said collar means to said bottle and fixing said collar means against continued rotation on and relative to said bottle in a first secured position for indicating the presence of said adapter, and for allowing free rotation of said collar means on and relative to said bottle in a second secured position for indicating absence of said adapter and providing a tactile indication of such absence.

2. The baby bottle assembly of claim 1 wherein said collar means comprises an annular top panel overlying said adapter and adapted to partially overlie said nipple, and a depending peripheral skirt encircling said bottle below said rim.

3. A baby bottle assembly including a bottle with a wide mouth defined by a peripheral rim, a feeding nipple alignable over said mouth radially inward of said rim and dimensionally of a size for free movement through said mouth, a removable adapter overlying and engaged with said rim, said adapter extending radially inward of said rim peripherally thereabout and partially overlying said mouth, said adapter extending partially inward of said nipple peripherally thereabout upon alignment of said nipple over said mouth to define a support for receiving said nipple thereon and precluding passage of said nipple through said mouth, collar means for clamping said nipple and said adapter against said rim, and cooperating means on said collar means and said bottle for securing said collar means to said bottle and for indicating the presence and absence of said adapter, said collar means comprising an annular top panel overlying said adapter and adapted to partially overlie said nipple, and a depending peripheral skirt encircling said bottle below said rim, said cooperating means on said collar means and said bottle comprising internal threads on said skirt projecting inward thereof, and cooperating external threads on said bottle projecting outward thereof whereby rotation of said collar means relative to said bottle will effect downward travel of said collar means on said bottle for a selective clamping and release of said nipple and adapter, said skirt being of a depth and said internal threads thereon being so located as to, with the presence of said adapter, maintain threaded engagement between said internal threads and said external threads throughout the full extent of downward movement of the collar means relative to said bottle, and so as to, in the absence of said adapter, position said internal threads on said skirt below and disengaged from said external threads on said bottle for free rotation of said collar means relative to said bottle whereby absence of said adapter is indicated.

4. The baby bottle assembly of claim 3 wherein said top panel of said collar means defines a central opening receiving said nipple therein, and means for frictionally releasably retaining said nipple in said opening.

5. A baby bottle assembly comprising a bottle with a neck portion defining a wide bottle mouth with a peripheral rim thereabout for introduction and removal of foodstuffs to and from said bottle, feeding means positionable in overlying relation to said mouth and in communication with the interior of said bottle for the selective withdrawal of foodstuff from said bottle through said mouth, said feeding means, in an in-use position, being dimensioned to freely pass through said mouth, an adapter mountable on said rim between said mouth and said feeding means, said adapter overlying said rim and extending radially inward thereof to partially underlie said feeding means to define a support for said feeding means and preclude passage of said feeding means through said mouth without interference with said communication between said feeding means and said interior of said bottle, a mounting collar including means engageable with said feeding means and over said adapter, complementary means on said collar and said neck portion rotatably engaged for movement of said collar relative to said bottle, upon rotation of said collar relative to said neck portion, to a seated position for clamping said feeding means and said adapter to said neck portion and for releasably locking said collar to said neck portion and against continuing relative rotational movement therebetween in said seated position, said collar, in the absence of said adapter mounted on said rim, being inwardly moveable beyond said seated position with said complementary means disengaging to allow continuous free rotation between said collar and said neck portion.

6. The bottle assembly of claim 5 wherein said engageable means includes an annular top panel adapted to overlie and engage said adapter and said collar further comprises a peripheral skirt integral with and depending from said top panel for encircling said neck portion, said complementary means comprising external screw threads on said neck portion and internal threads on said collar skirt, said external threads being positioned a distance below said rim, said internal threads being positioned a greater distance below said top panel whereby continuous inward rotational movement of said collar relative to said neck portion, in the absence of said adapter, will position said internal threads below said external threads for free rotation of said collar about said neck portion, said adapter, when mounted on said rim, engaging said top panel and precluding downward movement of said internal threads beyond said external threads.

7. The baby bottle assembly of claim 6 wherein said top panel includes a central opening therethrough, said feeding means being releasably engageable through said opening for rotational mounting with said collar into retained engagement with said adapter.

8. A baby bottle assembly including a bottle with a wide mouth therein, a peripheral rim about and defining said mouth, a feeding nipple alignable over said mouth, said nipple including an integral mounting flange, an adapter overlying said rim and projecting radially inward thereof into partially underlying relation to said nipple flange, said adapter defining an upwardly directed support surface, said support surface receiving and supporting said nipple flange, said nipple flange being radially inwardly spaced from said mouth rim peripherally thereabout whereby, in the absence of said adapter, said nipple is free to move through said mouth, a mounting collar, said collar including a top panel dimensioned to overlie said adapter and said nipple flange, said collar including an integral skirt depending below said bottle rim and surrounding said bottle below said rim, internal screw threads on said skirt and complementary external screw threads on said bottle for rotational downward movement of said collar on said bottle for clamping engagement of said nipple flange and said adapter against said rim, said external threads being spaced a first distance below said rim, said internal threads being spaced a greater second distance below said top panel sufficient, in the absence of said adapter and upon rotational downward movement of said collar, to position said internal threads downward below said external threads with said collar remaining freely rotatable relative to said bottle, said adapter defining a stop limiting downward movement of said collar and precluding downward movement of said internal threads below said external threads.

* * * * *